US010132321B2

(12) United States Patent
Ning

(10) Patent No.: US 10,132,321 B2
(45) Date of Patent: Nov. 20, 2018

(54) FAN SYSTEM HAVING AN EXTERNAL ROTOR

(71) Applicant: Zhongshan Broad-Ocean Motor Co., Ltd., Zhongshan (CN)

(72) Inventor: Huasheng Ning, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 359 days.

(21) Appl. No.: 14/792,581

(22) Filed: Jul. 6, 2015

(65) Prior Publication Data

US 2015/0308437 A1 Oct. 29, 2015

Related U.S. Application Data

(63) Continuation-in-part of application No. 12/830,363, filed on Jul. 5, 2010, now abandoned.

(30) Foreign Application Priority Data

Jul. 27, 2009 (CN) ..... 2009 2 0061726 U

(51) Int. Cl.

| | |
|---|---|
| ***F04D 25/06*** | (2006.01) |
| ***F04D 19/00*** | (2006.01) |
| ***F04D 29/34*** | (2006.01) |
| ***F04D 29/60*** | (2006.01) |

(52) U.S. Cl.

CPC ..... *F04D 25/06* (2013.01); *F04D 19/002* (2013.01); *F04D 29/34* (2013.01); *F04D 29/601* (2013.01)

(58) Field of Classification Search

CPC .... F04D 29/601; F04D 29/322; F04D 19/002; F04D 29/263; F04D 29/329; F04D 29/34

See application file for complete search history.

(56) References Cited

U.S. PATENT DOCUMENTS

| | | | | |
|---|---|---|---|---|
| 4,482,124 | A * | 11/1984 | Dochterman | F16F 15/00 248/604 |
| 5,083,904 | A * | 1/1992 | Masatsugu | F04D 29/325 416/204 R |
| 7,442,010 | B2 * | 10/2008 | Gruber | F04D 25/0613 416/169 A |
| 8,128,372 | B2 * | 3/2012 | Best | F04D 29/329 416/207 |
| 2012/0114503 | A1 * | 5/2012 | Wang | F04D 25/088 416/244 R |

* cited by examiner

*Primary Examiner* — Justin Seabe

(74) *Attorney, Agent, or Firm* — Matthias Scholl, PC; Matthias Scholl

(57) ABSTRACT

A fan system, including at least: an axial flow blade, a support including a clamping element and multiple installation pins, and an external rotor motor including an external rotor. The installation pins are extended from the outside of the clamping element. The axial flow blade is disposed on the installation pins. The clamping element is fit on the external rotor of the external rotor motor. The fan system features simple and convenient assembling, reliable connection, high production efficiency, low requirement for workers, and low production cost.

10 Claims, 15 Drawing Sheets

FAN SYSTEM HAVING AN EXTERNAL ROTOR

CROSS-REFERENCE TO RELATED APPLICATIONS

This Application is a continuation-in-part of, and claims domestic priority benefits to U.S. patent application Ser. No. 12/830,363, filed Jul. 5, 2010, now pending, which, pursuant to 35 U.S.C. § 119 and the Paris Convention Treaty, claims the benefit of Chinese Patent Application No. 200920061726.0 filed on Jul. 27, 2009. The contents of all of the aforementioned applications, including any intervening amendments thereto, are incorporated herein by reference in their entirety.

BACKGROUND OF THE INVENTION

Field of the Invention

The invention relates to a fan system, and more particularly to a fan system having an external rotor.

Description of the Related Art

A typical structure for a conventional fan system includes an air blade that is welded with external surface of a housing of the external rotor. However, requirements for a welding position and a welding direction of the air blade are stringent, and a high-level welding technology is needed, which cause high production cost and low production efficiency. A different structure employs a groove disposed on an outer surface of the housing, but installation of this axial flow fan is not reliable.

SUMMARY OF THE INVENTION

In view of the above-described problem, it is one objective of the invention to provide a fan system that features simple assembling, high production efficiency, reliable connection, and low production cost.

To achieve the above objectives, in accordance with one embodiment of the invention, provided is a fan system, the fan system comprising: an axial flow blade, a support comprising a clamping element and multiple installation pins, and an external rotor motor comprising an external rotor. The installation pins are extended from the outside of the clamping element, the axial flow blade is disposed on the installation pin, and the clamping element is fit on the external rotor of the external rotor motor.

In a class of this embodiment, the clamping element is formed by an annular body having an opening, and inner wall of the clamping element is interference-fit with outer wall of the external rotor.

In a class of this embodiment, a screw hole is disposed on the installation pin.

In a class of this embodiment, the axial flow blade is disposed on the installation pin via nuts and bolts.

In a class of this embodiment, a through hole is disposed on the installation pin.

In a class of this embodiment, the axial flow blade is disposed on the installation pin via riveting.

In a class of this embodiment, the axial flow blade is disposed on the installation pin via welding.

In a class of this embodiment, the axial flow blade is disposed on the installation pin via buckling.

In a class of this embodiment, the clamping element and the installation pin are integrally formed.

In a class of this embodiment, the clamping element is connected to the installation pin via welding, buckling, or riveting.

In accordance with another embodiment of the invention, provided is a fan system, the fan system comprising an axial flow blade, a support comprising an annular sleeve and multiple installation pins, an external rotor motor comprising an external rotor, and an external convex ring. The installation pins are extended from the outside of the annular sleeve, the axial flow blade is disposed on the installation pin, the annular sleeve is fit on the external rotor of the external rotor motor, and the external convex ring is disposed between the annular sleeve and the installation pin.

In a class of this embodiment, the annular sleeve is integrally formed, and the inner wall of the annular sleeve is interference-fit with the outer wall of the external rotor.

In a class of this embodiment, a screw hole is disposed on the installation pin.

In a class of this embodiment, the axial flow blade is disposed on the installation pin via nuts and bolts.

In a class of this embodiment, a through hole is disposed on the installation pin.

In a class of this embodiment, the axial flow blade is disposed on the installation pin via riveting.

In a class of this embodiment, the axial flow blade is disposed on the installation pin via welding.

In a class of this embodiment, the axial flow blade is disposed on the installation pin via buckling.

In a class of this embodiment, the annular sleeve and the installation pin are integrally formed.

In a class of this embodiment, the annular sleeve is connected to the installation pin via welding, buckling, or riveting.

In accordance with another embodiment of the invention, provided is a fan system, the fan system comprising: multiple axial flow blades, a support comprising a first part and a second part, and an external rotor motor comprising an external rotor and an inner stator. The first part comprises an annular sleeve and multiple installation pins. The second part comprises a clamping element. The first part is connected to the second part, both the first part and the second part are fit on the external rotor of the external rotor motor, and the support encloses the outer wall of the external rotor. The installation pins are extended from the outside of the annular sleeve, and the multiple axial flow blades are respectively disposed on the installation pins.

In a class of this embodiment, an end of the annular sleeve is welded to an end of the clamping element and a welding line is formed between the annular sleeve and the clamping element.

In a class of this embodiment, the inner wall of the annular sleeve is interference-fit with the outer wall of the external rotor.

In a class of this embodiment, the clamping element is formed by an annular body having two ends and an opening, and two linkage parts are respectively formed on the two ends of the clamping element. A fastening device connects the two linkage parts and fixes the clamping element on the outer wall of the external rotor.

In a class of this embodiment, the fastening device comprises a nut and a bolt.

In a class of this embodiment, a screw hole is disposed on each of the installation pins.

In a class of this embodiment, the multiple axial flow blades are respectively disposed on the installation pins via nuts and bolts.

In a class of this embodiment, a through hole is disposed on each of the installation pins.

In a class of this embodiment, the multiple axial flow blades are respectively disposed on the installation pins via riveting.

In a class of this embodiment, the multiple axial flow blades are respectively disposed on the installation pins via welding.

In a class of this embodiment, the multiple axial flow blades are respectively disposed on the installation pins via buckling.

In a class of this embodiment, the annular sleeve and the installation pins are integrally formed.

In a class of this embodiment, the annular sleeve is connected to the installation pins via welding, buckling, or riveting.

In accordance with another embodiment of the invention, provided is a fan system, the fan system comprising: multiple axial flow blades, a support comprising a first part and a second part, and an external rotor motor comprising an external rotor and an inner stator. The first part comprises an annular sleeve. The second part comprises a clamping element and multiple installation pins. The second part is connected to the first part, both the first part and the second part are fit on the external rotor of the external rotor motor, and the support encloses the outer wall of the external rotor. The installation pins are extended from the outside of the clamping element, and the multiple axial flow blades are respectively disposed on the installation pins.

In a class of this embodiment, an end of the annular sleeve is welded to an end of the clamping element and a welding line is formed between the annular sleeve and the clamping element.

In a class of this embodiment, the inner wall of the annular sleeve is interference-fit with the outer wall of the external rotor.

In a class of this embodiment, the clamping element is formed by an annular body having two ends and an opening, and two linkage parts are respectively formed on the two ends of the clamping element. A fastening device connects the two linkage parts and fixes the clamping element on the outer wall of the external rotor.

In a class of this embodiment, the fastening device comprises a nut and a bolt.

In a class of this embodiment, a screw hole is disposed on each of the installation pins.

In a class of this embodiment, the multiple axial flow blades are respectively disposed on the installation pins via nuts and bolts.

In a class of this embodiment, a through hole is disposed on each of the installation pins.

In a class of this embodiment, the multiple axial flow blades are respectively disposed on the installation pins via riveting.

In a class of this embodiment, the multiple axial flow blades are respectively disposed on the installation pins via welding.

In a class of this embodiment, the multiple axial flow blades are respectively disposed on the installation pins via buckling.

In a class of this embodiment, the clamping element and the installation pins are integrally formed.

In a class of this embodiment, the clamping element is connected to the installation pins via welding, buckling, or riveting.

In accordance with another embodiment of the invention, provided is a fan system, the fan system comprising multiple axial flow blades, a support comprising an annular sleeve and multiple installation pins, an external rotor motor, and a clamping element. The installation pins are extended from the outside of the annular sleeve, the multiple axial flow blades are respectively disposed on the installation pins, the annular sleeve is fit on the outer surface of the external rotor motor, and the clamping element is fit on the outer surface of the annular sleeve and the inner surface of the clamping element contacts the outer surface of the annular sleeve.

In a class of this embodiment, the clamping element is formed by an annular body having two ends and an opening, and two linkage parts are respectively formed on the two ends of the clamping element. A fastening device connects the two linkage parts and fixes the clamping element on the outer surface of the annular sleeve.

In a class of this embodiment, the annular sleeve is integrally formed, and the inner wall of the annular sleeve is interference-fit with the outer wall of the external rotor motor.

In a class of this embodiment, a screw hole is disposed on the installation pins.

In a class of this embodiment, the multiple axial flow blades are respectively disposed on the installation pins via nuts and bolts.

In a class of this embodiment, a through hole is disposed on the installation pins.

In a class of this embodiment, the multiple axial flow blades are respectively disposed on the installation pins via riveting.

In a class of this embodiment, the multiple axial flow blades are respectively disposed on the installation pins via welding.

In a class of this embodiment, the multiple axial flow blades are respectively disposed on the installation pins via buckling.

In a class of this embodiment, the annular sleeve and the installation pins are integrally formed.

In a class of this embodiment, the annular sleeve is connected to the installation pins via welding, buckling, or riveting.

Advantages of the invention are as follows: 1) the annular sleeve and the clamping element on the support are fit on the housing of the external rotor of the external rotor motor, and the inner wall of the annular sleeve is interference-fit with the outer wall of the external rotor, which results in simple assembling, reliable connection, high production efficiency, low requirement for workers, and low production cost; and 2) the structural arrangement of the support and the axial flow blades ensures that the axial flow blades are installed on the external rotor in a stable manner and that the axial flow blades and the external rotor rotate in a stable and balanced manner during operation.

BRIEF DESCRIPTION OF THE DRAWINGS

Detailed description will be given below in conjunction with accompanying drawings, in which.

DETAILED DESCRIPTION OF THE EMBODIMENTS

Figure 1:
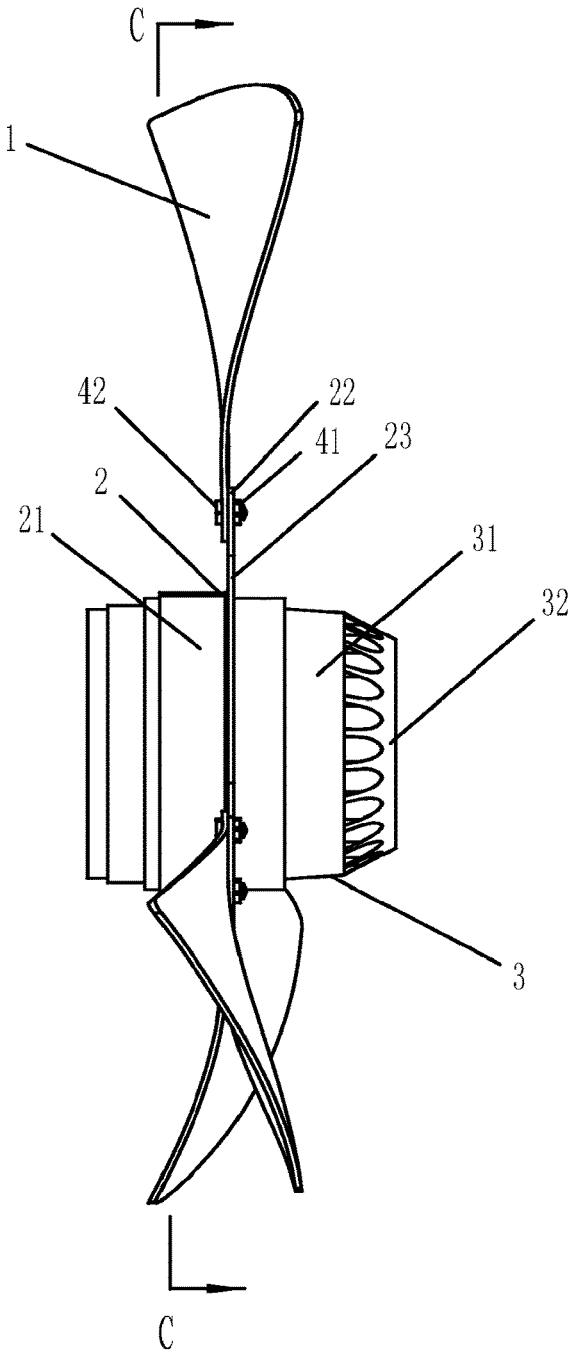
FIG. 1 is a schematic view of a fan system of a first exemplary embodiment of the invention.
Figure 2:
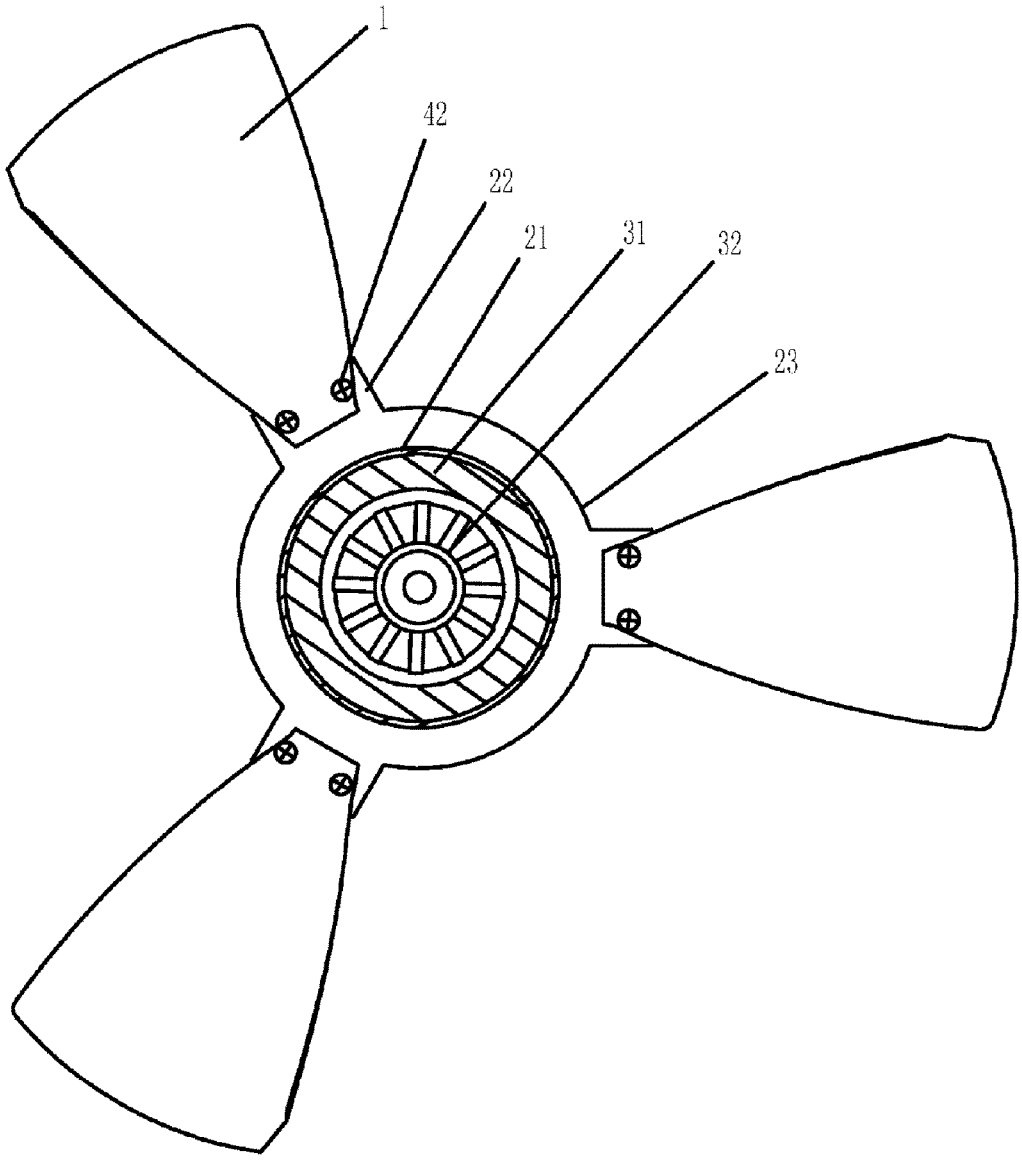
FIG. 2 is a cross-sectional view of FIG. 1 along a line C-C.

As shown in FIGS. 1 and 2, a fan system of a first embodiment of the invention comprises an axial flow blade 1, a support 2 comprising an annular sleeve 21 and multiple installation pins 22, an external rotor motor 3 comprising an external rotor 31 and an inner stator 32, and an external convex ring 23.

The installation pins 22 are extended from the outside of the annular sleeve 21.

The axial flow blade 1 is disposed on the installation pin 22.

The annular sleeve 21 is fit on the external rotor 31 of the external rotor motor 3, and is integrally formed.

The external convex ring 23 is disposed between the annular sleeve 21 and the installation pin 22, and operates to increase radial dimension and to improve structural strength.

Inner wall of the annular sleeve 21 is interference-fit with outer wall of the external rotor 31.

A screw hole is disposed on the installation pin 22, and the axial flow blade 1 is disposed on the installation pin 22 via nuts 42 and bolts 41. The annular sleeve 21 and the installation pin 22 are integrally formed.

Figure 3:
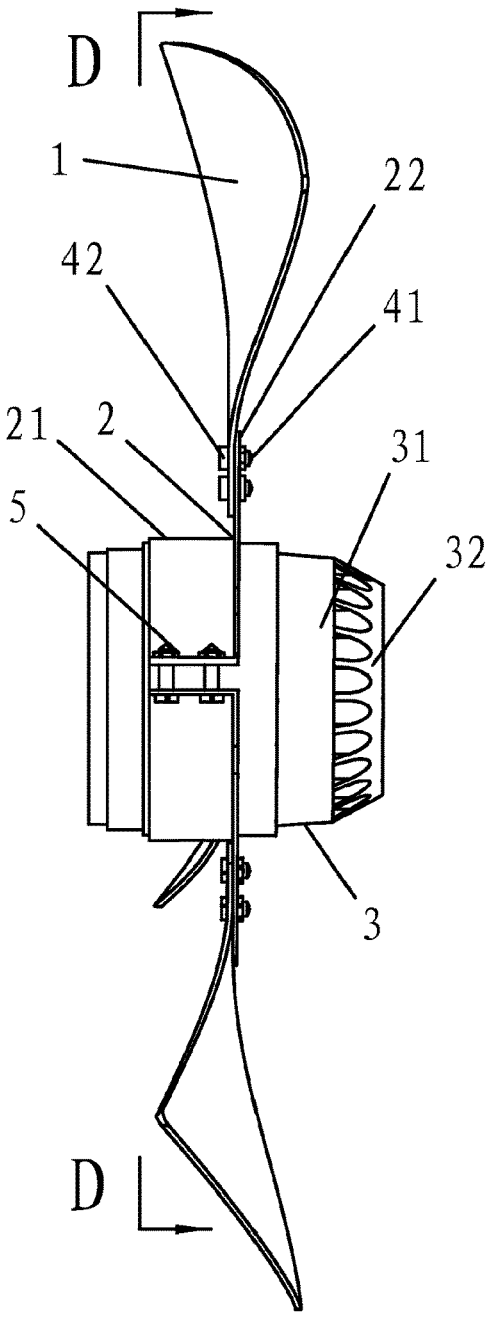
FIG. 3 is a schematic view of a fan system of a second exemplary embodiment of the invention.
Figure 4:
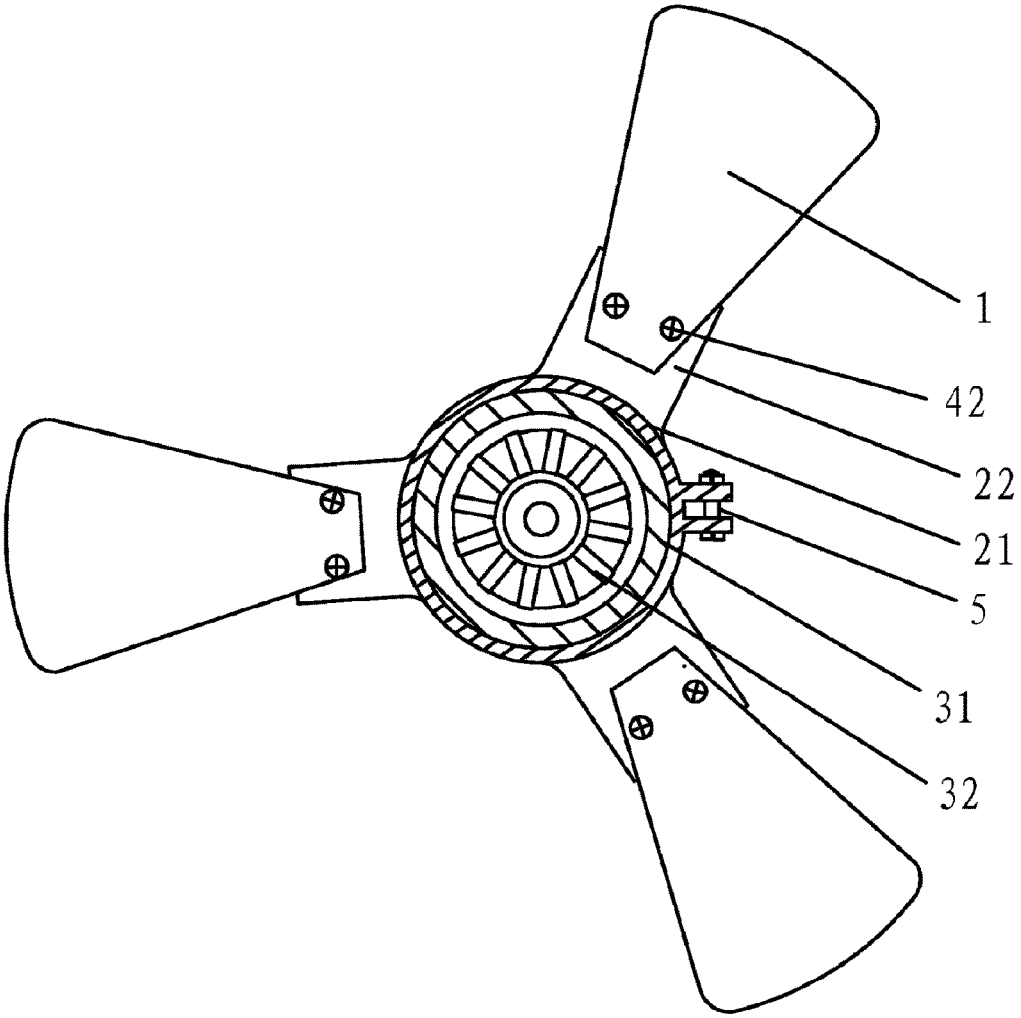
FIG. 4 is a cross-sectional view of FIG. 3 along a line D-D.

As shown in FIGS. 3 and 4, a fan system of a second embodiment of the invention comprises an axial flow blade 1, a support 2 comprising a clamping element 21 and multiple installation pins 22, and an external rotor motor 3 comprising an external rotor 31 and an inner stator 32.

The installation pins 22 are extended from the outside of the clamping element 21.

The axial flow blade 1 is disposed on the installation pin 22.

The clamping element 21 is fit on the external rotor 31 of the external rotor motor 3, and is formed by an annular body having an opening via a fastening device 5 or via welding.

The inner wall of the clamping element 21 is interference-fit with the outer wall of the external rotor 31.

A screw hole is disposed on the installation pin 22, and the axial flow blade 1 is disposed on the installation pin 22 via nuts 42 and bolts 41. The clamping element 21 and the installation pin 22 are integrally formed.

Figure 5:
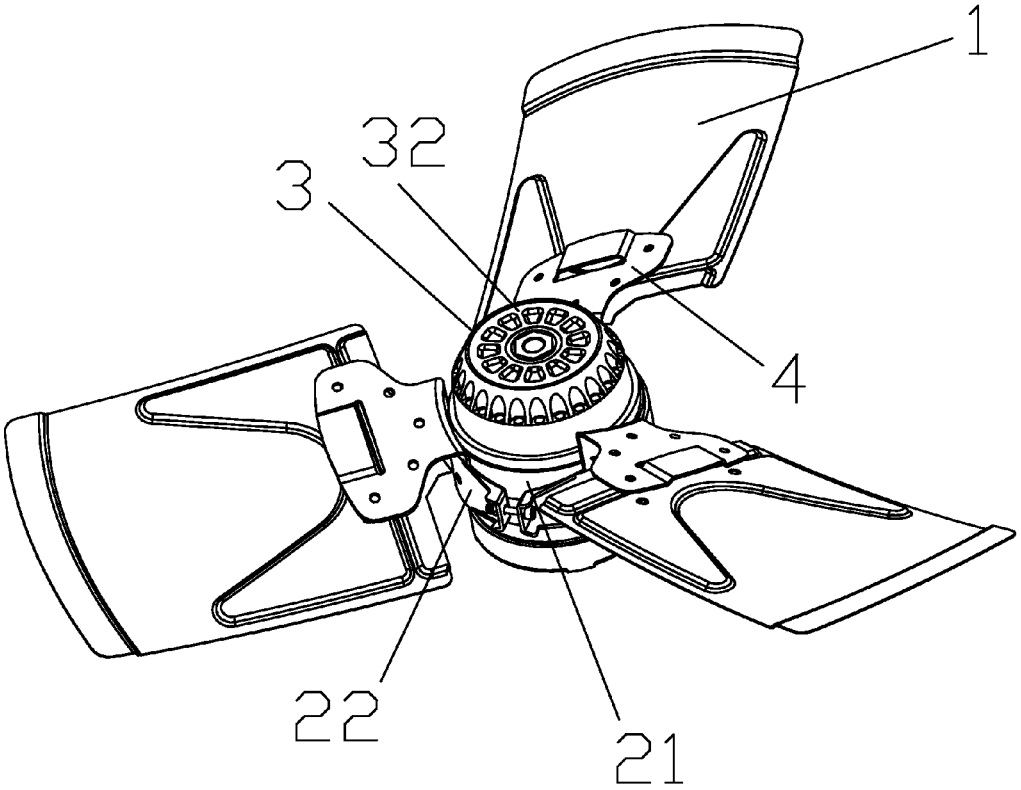
FIG. 5 is a schematic view of a fan system of a third exemplary embodiment of the invention.
Figure 6:
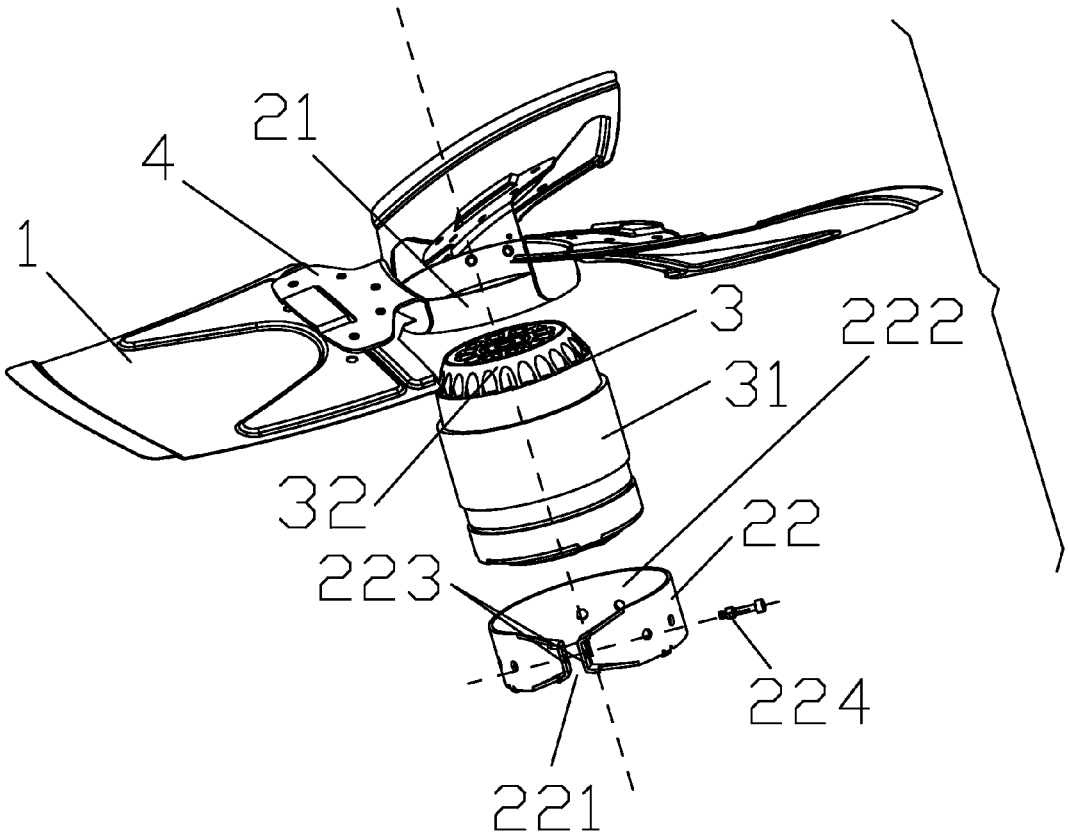
FIG. 6 is an explosive view of a fan system of the third exemplary embodiment of the invention.
Figure 7:
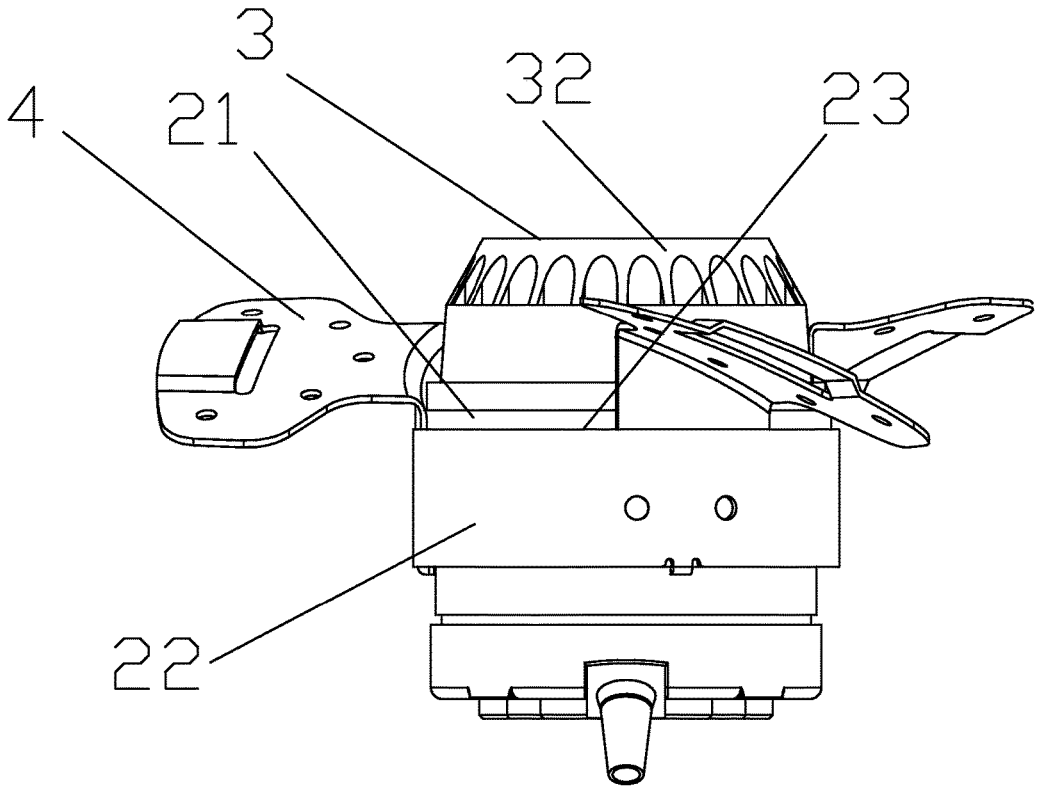
FIG. 7 is a front view of a fan system of the third exemplary embodiment of the invention.

As shown in FIGS. 5-7, a fan system of a third embodiment of the invention comprises multiple axial flow blades 1, a support comprising a first part and a second part, an external rotor motor 3 comprising an external rotor 31 and an inner stator 32.

The first part comprises an annular sleeve 21 and multiple installation pins 4. The second part is a clamping element 22. The first part is connected to the second part, both the first part and the second part are fit on the external rotor 31, and the support encloses the outer wall of the external rotor 31. The installation pins 4 are extended from the outside of the annular sleeve 21, and the multiple axial flow blades 1 are respectively disposed on the installation pins 4.

An end of the annular sleeve 21 is welded to an end of the clamping element 22 and a welding line 23 is formed between the annular sleeve 21 and the clamping element 22.

The inner wall of the annular sleeve 21 is interference-fit with the outer wall of the external rotor 31.

The clamping element 22 is formed by an annular body 222 having two ends and an opening 221, and two linkage parts 223 are respectively formed on the two ends of the clamping element 22. A fastening device 224 connects the two linkage parts 223 and fixes the clamping element 22 on the outer wall of the external rotor 31. The fastening device 224 comprises a nut and a bolt.

A screw hole is disposed on each of the installation pins 4, and the multiple axial flow blades 1 are respectively disposed on the installation pins 4 via nuts and bolts. The annular sleeve 21 and the installation pins 4 are integrally formed.

In the third embodiment, the multiple axial flow blades 1 are respectively disposed on the installation pins 4, and the inner wall of the annular sleeve 21 is interference-fit with the outer wall of the external rotor 31. During operation, the multiple axial flow blades 1, the support comprising the annular sleeve 21 and the clamping element 22, and the external rotor 31 rotate while the inner stator 32 remains stationary. Because the annular sleeve 21 is annular and has a symmetric shape, the multiple axial flow blades 1 rotate in a stable and balanced manner at normal operating temperature. When the operating temperature increases, the inner wall of the annular sleeve 21 and the outer wall of the external rotor 31 expand at different rates, and the connection between the annular sleeve 21 and the external rotor 31 may become loosened. On the other hand, when the operating temperature decreases, the inner wall of the annular sleeve 21 and the outer wall of the external rotor 31 retract at different rates, and the connection between the annular sleeve 21 and the external rotor 31 may also become loosened. Once the connection between the annular sleeve 21 and the external rotor 31 becomes loosened, a user can fasten the support by adjusting the fastening device 224 and fastening the clamping element 22 on the external rotor 31. In other words, the clamping element 22 functions to adjust the support and to prevent the support from loosening from the external rotor 31. Therefore, the fan system of the third embodiment operates in a stable and balanced manner during operation.

Figure 8:
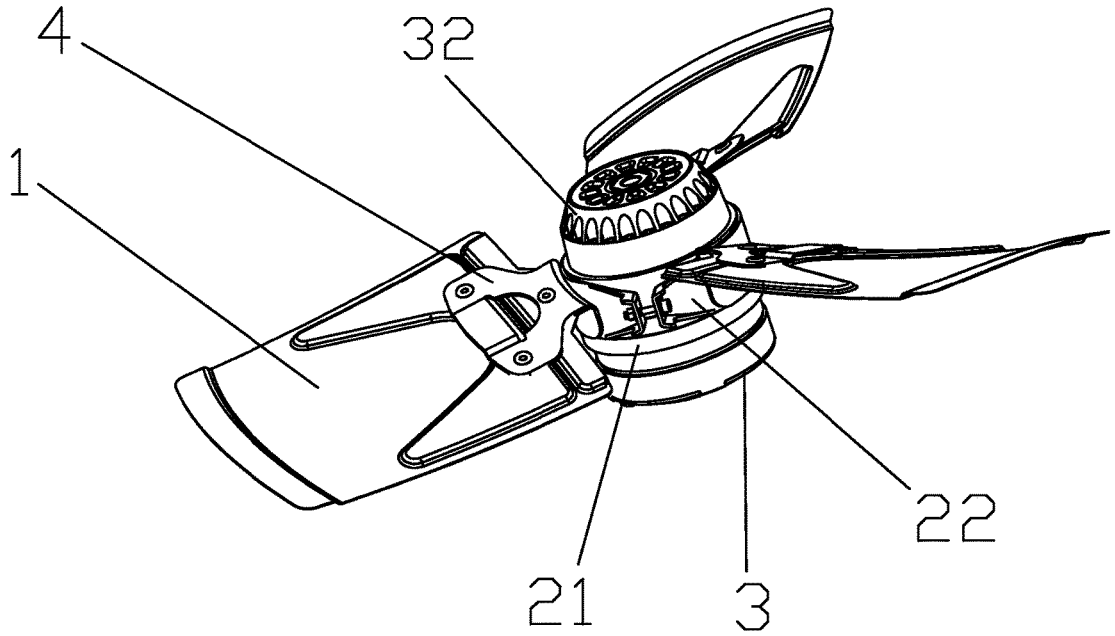
FIG. 8 is a schematic view of a fan system of a fourth exemplary embodiment of the invention.
Figure 9:
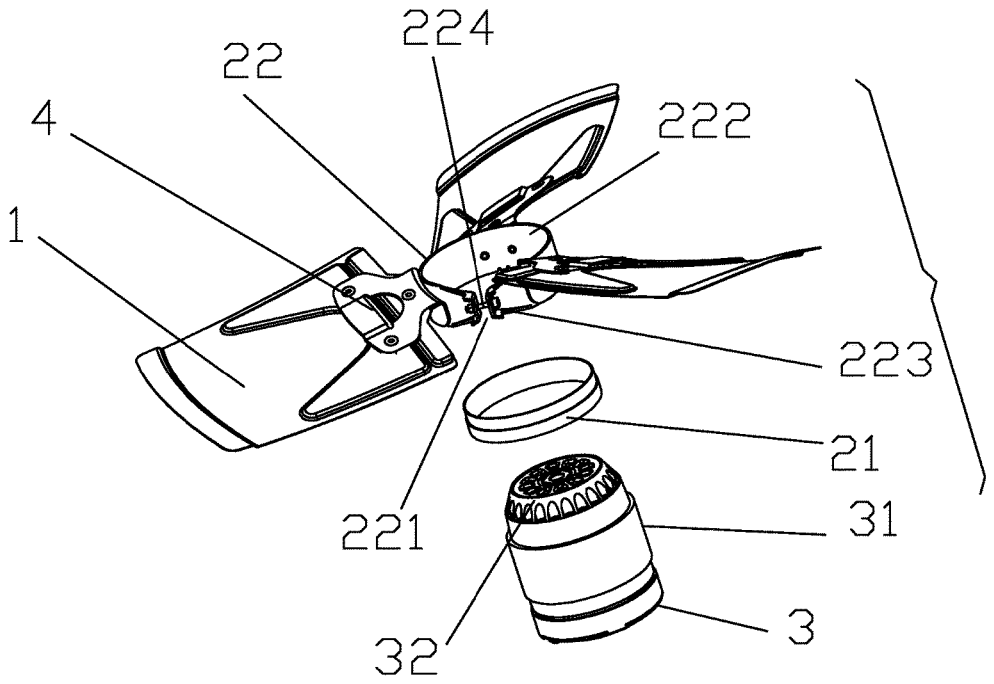
FIG. 9 is an explosive view of a fan system of the fourth exemplary embodiment of the invention.
Figure 10:
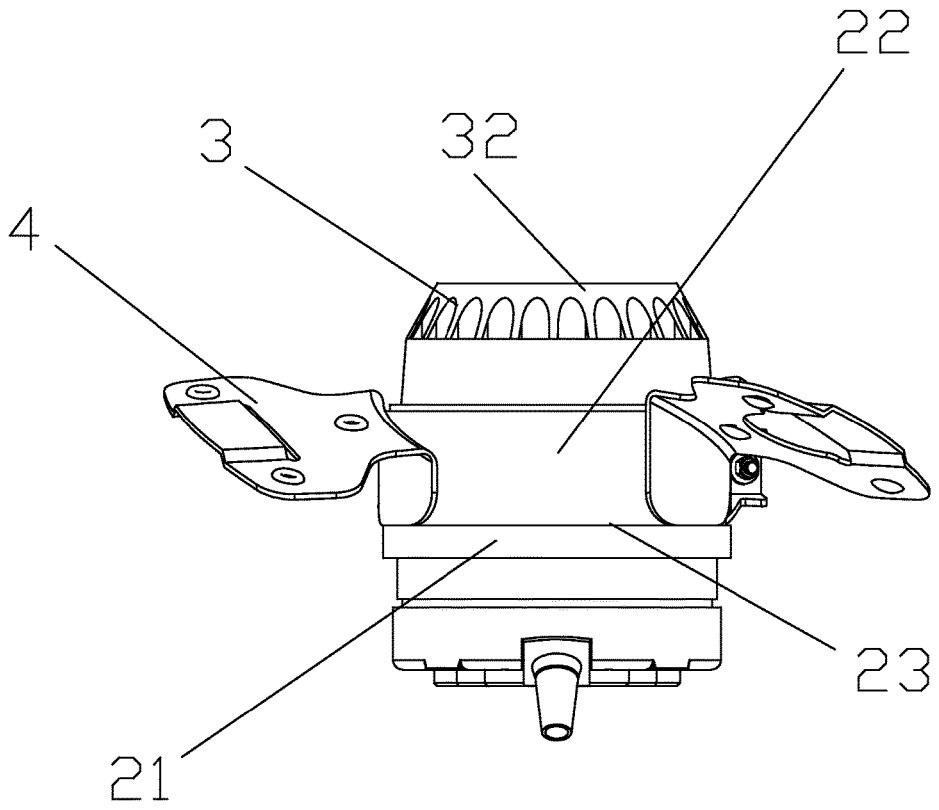
FIG. 10 is a front view of a fan system of the fourth exemplary embodiment of the invention.
Figure 11:
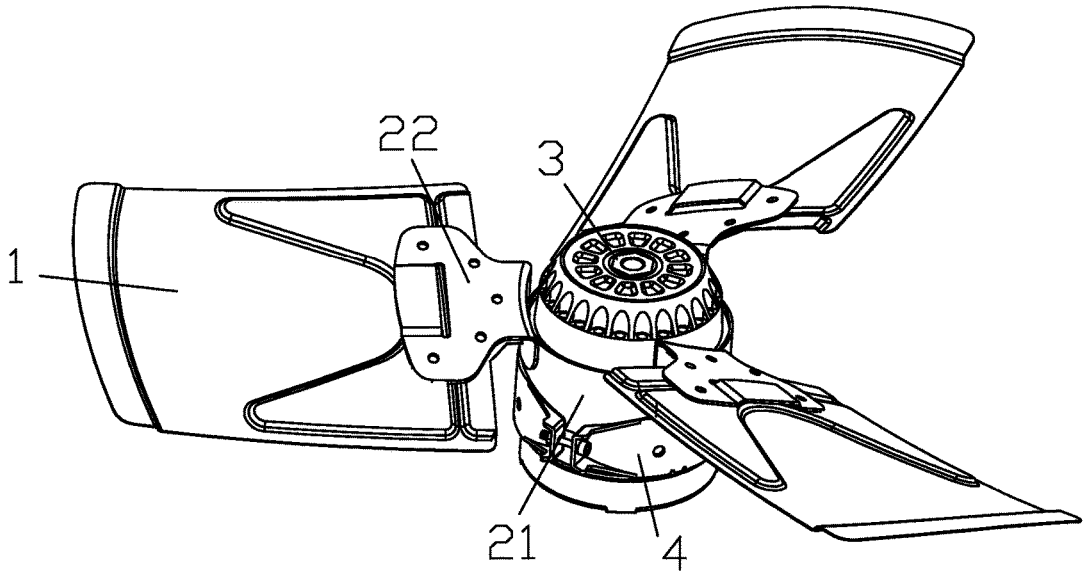
FIG. 11 is a schematic view of a fan system of a fifth exemplary embodiment of the invention.
Figure 12:
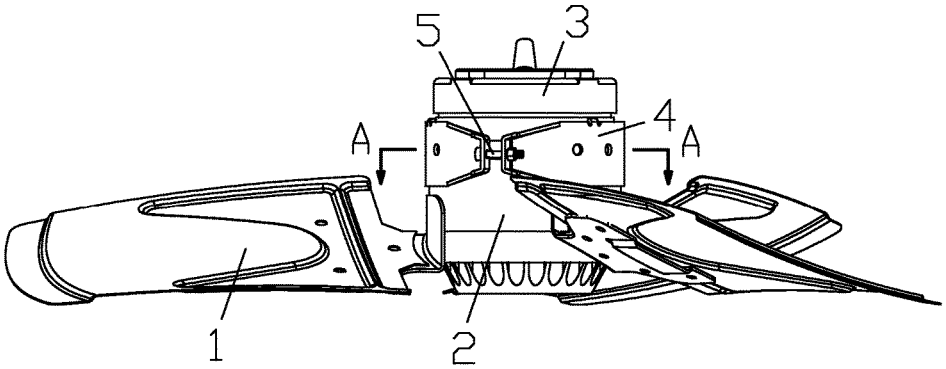
FIG. 12 is a front view of a fan system of the fifth exemplary embodiment of the invention.
Figure 13:
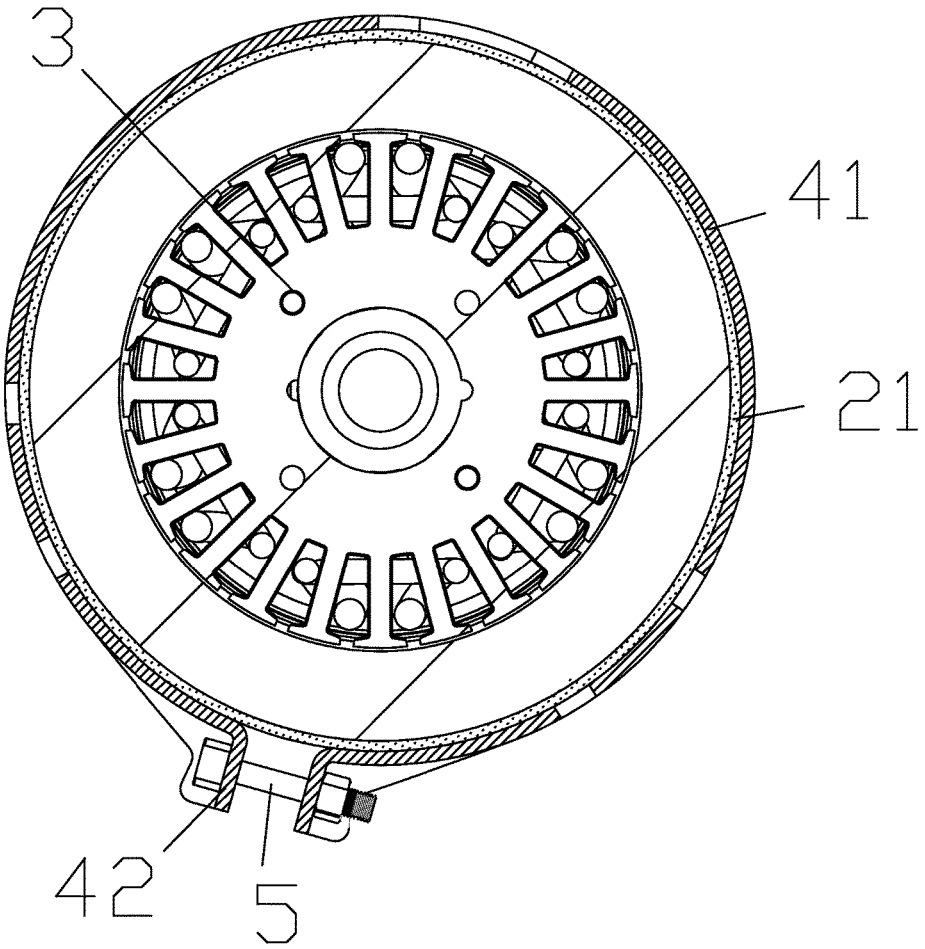
FIG. 13 is a cross-sectional view of a fan system in FIG. 12 along a line A-A.
Figure 14:
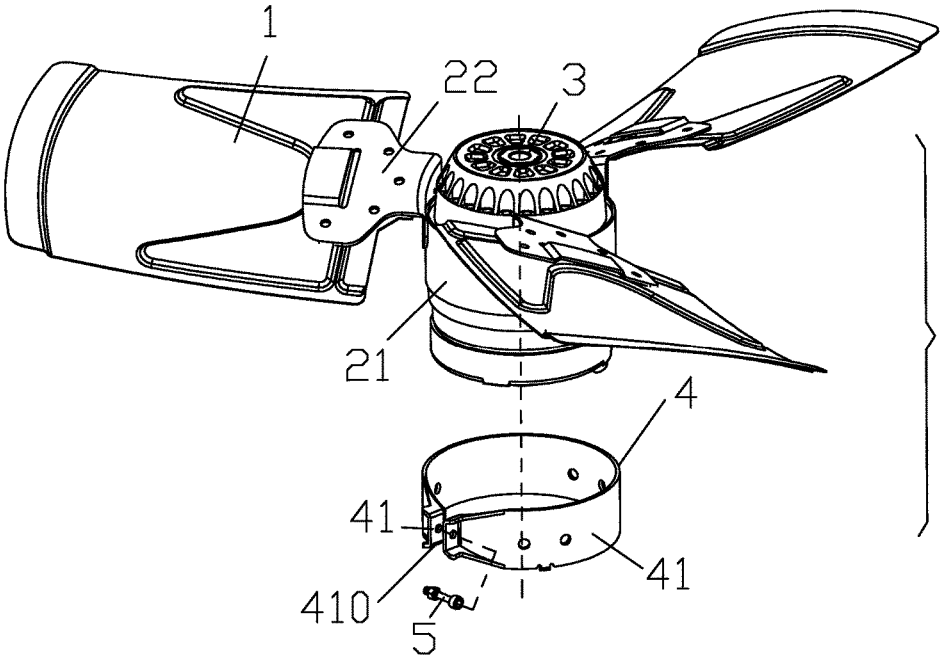
FIG. 14 is a first explosive view of a fan system of the fifth exemplary embodiment of the invention.
Figure 15:
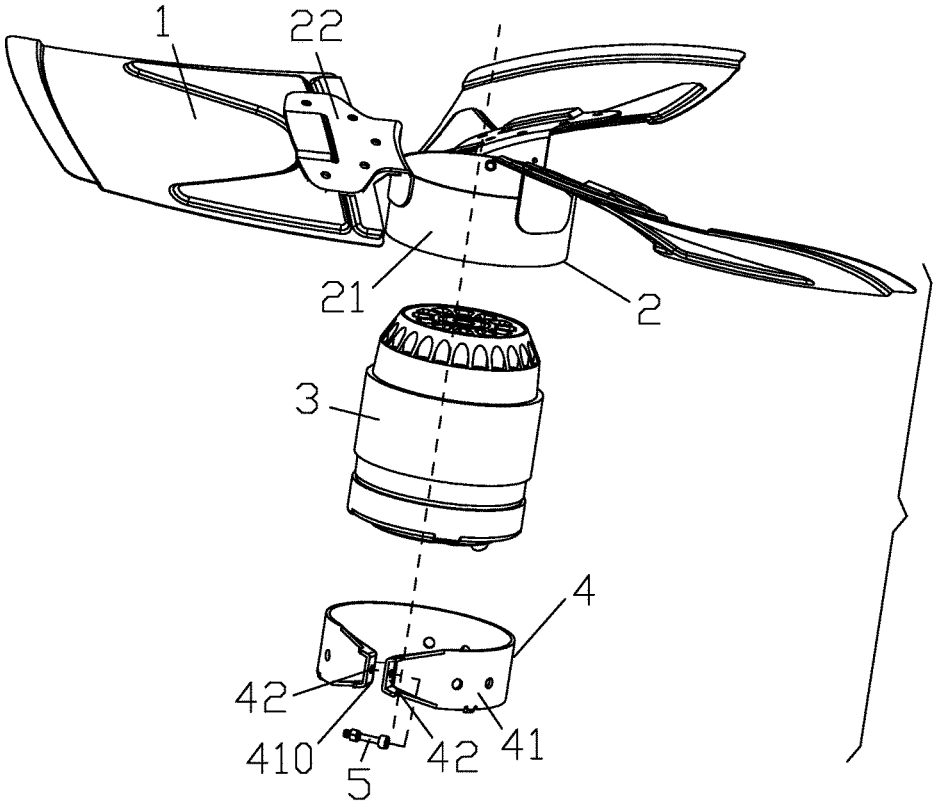
FIG. 15 is a second explosive view of a fan system of the fifth exemplary embodiment of the invention.

As shown in FIGS. 8-10, a fan system of a fourth embodiment of the invention comprises multiple axial flow blades 1, a support comprising a first part and a second part, an external rotor motor 3 comprising an external rotor 31 and an inner stator 32.

The first part is an annular sleeve 21. The second part comprises a clamping element 22 and multiple installation pins 4. The second part is connected to the first part, both the first part and the second part are fit on the external rotor 31, and the support encloses the outer wall of the external rotor 31. The multiple installation pins 4 are extended from the outside of the clamping element 22, and the multiple axial flow blades 1 are respectively disposed on the installation pins 4.

An end of the annular sleeve 21 is welded to an end of the clamping element 22 and a welding line 23 is formed between the annular sleeve 21 and the clamping element 22.

The inner wall of the annular sleeve 21 is interference-fit with the outer wall of the external rotor 31.

The clamping element 22 is formed by an annular body 222 having two ends and an opening 221, and two linkage parts 223 are respectively formed on the two ends of the clamping element 22. A fastening device 224 connects the two linkage parts 223 and fixes the clamping element 22 on the outer wall of the external rotor 31. The fastening device 224 comprises a nut and a bolt.

A screw hole is disposed on each of the installation pins 4, and the multiple axial flow blades 1 are respectively disposed on the installation pins 4 via nuts and bolts. The clamping element 22 and the installation pins 4 are integrally formed.

In the fourth embodiment, multiple installation pins 4 are extended from the outside of the clamping element 22, and the axial flow blades 1 are respectively disposed on the installation pins 4. During operation, the multiple axial flow blades 1, the support comprising the annular sleeve 21 and the clamping element 22, and the external rotor 31 rotate while the inner stator 32 remains stationary. When the operating temperature increases, the inner wall of the annular sleeve 21 and the outer wall of the external rotor 31 expand at different rates, and the connection between the annular sleeve 21 and the external rotor 31 may become loosened. On the other hand, when the operating temperature decreases, the inner wall of the annular sleeve 21 and the outer wall of the external rotor 31 retract at different rates, and the connection between the annular sleeve 21 and the external rotor 31 may also become loosened. Once the connection between the annular sleeve 21 and the external rotor 31 becomes loosened, a user can fasten the support by adjusting the fastening device 224 and fastening the clamping element 22 on the external rotor 31. In other words, the clamping element 22 functions to adjust the support and to prevent the support from loosening from the external rotor 31. Because the clamping element 22 has two ends and a fastening device connects the two ends, the mass distribution of the clamping element 22 is not uniform. Whereas, because the annular sleeve 21 is annular and has a symmetric shape and because the annular sleeve 21 is connected to the clamping element 22, the center of gravity of the support substantially coincides with the rotational axis of the motor. In other words, the function of the annular sleeve 21 is to balance the mass distribution of the support and to balance the rotation of the multiple axial flow blades 1 and the external rotor 31. Therefore, the fan system of the fourth embodiment operates in a stable and balanced manner during operation.

As shown in FIGS. 11-15, a fan system of a fifth embodiment of the invention comprises multiple axial flow blades 1, a support 2 comprising an annular sleeve 21 and multiple installation pins 22, an external rotor motor 3, and a clamping element 4.

The installation pins 22 are extended from the outside of the annular sleeve 21, the multiple axial flow blades 1 are respectively disposed on the installation pins 22, the annular sleeve 21 is fit on the outer surface of the external rotor motor 3, and the clamping element 4 is fit on the outer surface of the annular sleeve 21 and the inner surface of the clamping element 4 contacts the outer surface of the annular sleeve 21.

The clamping element 4 is formed by an annular body 41 having two ends and an opening 410, and two linkage parts 42 are respectively formed on the two ends of the clamping element 4. A fastening device 5 connects the two linkage parts 42 and fixes the clamping element 4 on the outer surface of the annular sleeve 21.

The annular sleeve 21 is integrally formed, and the inner wall of the annular sleeve 21 is interference-fit with the outer wall of the external rotor motor 3.

A screw hole is disposed on each of the installation pins 22, and the multiple axial flow blades 1 are respectively disposed on the installation pins 22 via nuts and bolts. The clamping element 4 and the installation pins 22 are integrally formed.

In the fifth embodiment, the multiple axial flow blades 1 are respectively disposed on the installation pins 22, and the inner wall of the annular sleeve 21 is interference-fit with the outer wall of the external rotor motor 3. During operation, the multiple axial flow blades 1, the support 2, the clamping element 4, and the external rotor of the external rotor motor 3 rotate while the inner stator of the external rotor motor 3 remains stationary. Because the annular sleeve 21 is annular and has a symmetric shape, the multiple axial flow blades 1 rotate in a stable and balanced manner at normal operating temperature. When the operating temperature increases, the inner wall of the annular sleeve 21 and the outer wall of the external rotor motor 3 expand at different rates, and the connection between the annular sleeve 21 and the external rotor motor 3 may become loosened. On the other hand, when the operating temperature decreases, the inner wall of the annular sleeve 21 and the outer wall of the external rotor motor 3 retract at different rates, and the connection between the annular sleeve 21 and the external rotor motor 3 may also become loosened. Once the connection between the annular sleeve 21 and the external rotor motor 3 becomes loosened, a user can fasten the support 2 by adjusting the fastening device 5 and fastening the clamping element 4 on the external rotor 31. In other words, the clamping element 4 functions to adjust the support 2 and to prevent the support 2 from loosening from the external rotor motor 3. Therefore, the fan system of the fifth embodiment operates in a stable and balanced manner during operation.

The invention features simple and convenient assembling, reliable connection, high production efficiency, low requirement for workers, and low production cost.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A fan system, comprising:

multiple axial flow blades;

a support comprising a first part and a second part, said first part comprising an annular sleeve and multiple installation pins, said second part comprising a clamping element; and an external rotor motor comprising an external rotor and an inner stator; wherein:

said first part is connected to said second part;

said multiple installation pins are extended from the outside of said annular sleeve;

said first part and said second part are fit on said external rotor;

said support encloses an outer wall of said external rotor;

said multiple axial flow blades are respectively disposed on said multiple installation pins;

said annular sleeve is disposed between said external rotor and said clamping element;

said annular sleeve is fixed on said external rotor via said clamping element;

said clamping element is spatially-separated from said multiple axial flow blades;

said clamping element is an annular band that is extended from a first band end to a second band end;

said first band end and said second band end are connected by a fastening device;

said first band end is separated from said second band end by a distance; and said distance is adjustable.

2. The fan system of claim 1, wherein an end of said annular sleeve is welded to an end of said clamping element and a welding line is formed between said annular sleeve and said clamping element.

3. The fan system of claim 1, wherein two linkage parts are respectively formed on said first band end and said second band end, and said fastening device connects said two linkage parts.

4. The fan system of claim 3, wherein said fastening device comprises a nut and a bolt.

5. The fan system of claim 1, wherein a screw hole is disposed on each of said multiple installation pins, and said multiple axial flow blades are respectively disposed on said multiple installation pins via nuts and bolts.

6. The fan system of claim 1, wherein a through hole is disposed on each of said multiple installation pins, and said multiple axial flow blades are respectively disposed on said multiple installation pins via riveting, welding, or buckling.

7. The fan system of claim 1, wherein said annular sleeve and said multiple installation pins are integrally formed.

8. The fan system of claim 7, wherein a through hole is disposed on each of said multiple installation pins, and said multiple axial flow blades are respectively disposed on said multiple installation pins via riveting, welding, or buckling.

9. The fan system of claim 1, wherein said annular sleeve is connected to said multiple installation pins via welding, buckling, or riveting.

10. The fan system of claim 1, wherein an inner wall of the annular sleeve is interference-fit with said outer wall of said external rotor.

* * * * *